US007022003B1

(12) United States Patent
Hughes

(10) Patent No.: US 7,022,003 B1
(45) Date of Patent: Apr. 4, 2006

(54) POWDER DRIVEN SURFACE FINISHING APPARATUS

(76) Inventor: John E. Q. Hughes, 816 E. Desert Ranch Rd., Phoenix, AZ (US) 85086

( * ) Notice: Subject to any disclaimer, the term of this patent is extended or adjusted under 35 U.S.C. 154(b) by 0 days.

(21) Appl. No.: 10/430,587

(22) Filed: May 7, 2003

(51) Int. Cl.
*B24B 27/08* (2006.01)

(52) U.S. Cl. ..... 451/352; 451/358; 451/456; 451/524

(58) Field of Classification Search ..... 451/178, 451/344, 352, 354, 358, 451, 455, 456, 523, 451/524, 525
See application file for complete search history.

(56) References Cited

U.S. PATENT DOCUMENTS 1,770,643 A * 7/1930 Giambertoni ..... 15/52.1
3,172,138 A * 3/1965 Price ..... 15/98
3,619,948 A * 11/1971 Burns ..... 451/178
3,793,782 A 2/1974 Bowling
4,268,769 A * 5/1981 Dorner et al. ..... 310/67 R
4,780,992 A 11/1988 McKervey
4,875,246 A * 10/1989 MacGregor ..... 15/98
5,301,472 A 4/1994 Lyng
5,567,197 A 10/1996 Evensen
5,947,806 A 9/1999 Rhoads
6,041,463 A 3/2000 Stauch
6,266,838 B1 * 7/2001 Caruso ..... 15/98
6,772,476 B1 * 8/2004 Park ..... 15/389

* cited by examiner

*Primary Examiner*—Timothy V. Eley
(74) *Attorney, Agent, or Firm*—Parsons & Goltry; Michael W. Goltry; Robert A. Parsons

(57) ABSTRACT

A surface finishing device includes a surface finishing drum having opposing ends and a chamber therebetween, an elongate fixture having a handled proximal extremity and an opposing distal extremity, and a support element, which is carried by the distal extremity and extends through one of the ends of the surface finishing drum into the chamber. An electric motor is disposed in the chamber and is carried by the support element. A drive shaft is also disposed in the chamber and couples the motor to the other of the ends of the surface finishing drum.

10 Claims, 6 Drawing Sheets

20
21
22
23
24
25
30
35
60
61
62
70
71
72
73
X
Y 20
21
22
23
24
25
60
61
62
70
71
72
73

80
90
80B
55
51
50
30
80A
32
46
45
47
40
34
40A
81A
31
81B
91
33
40B
24
41
81
25
33A
34
36
35
23
21
X 96
80B
81B
31
25
91
90
81A
80A
81
97
80
30
95

Fig. 9
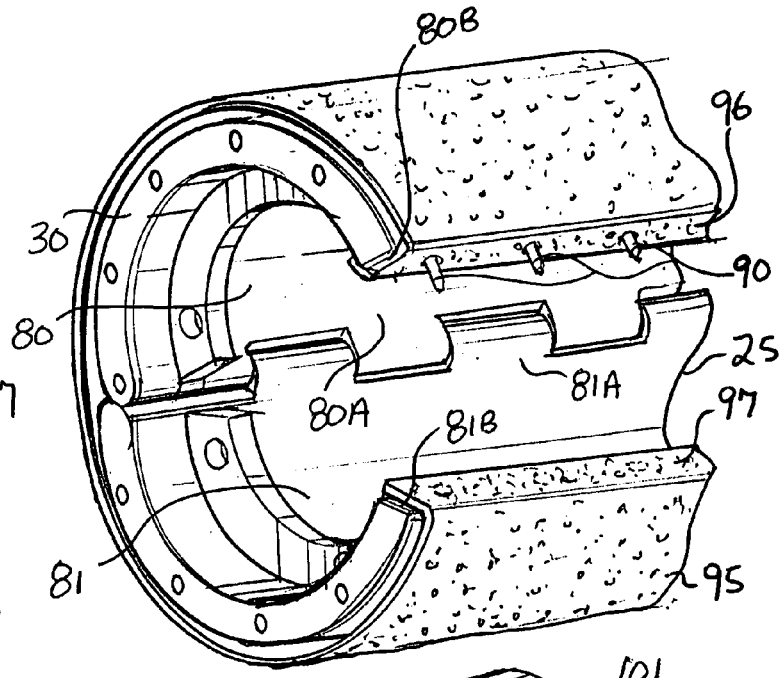
Fig. 10
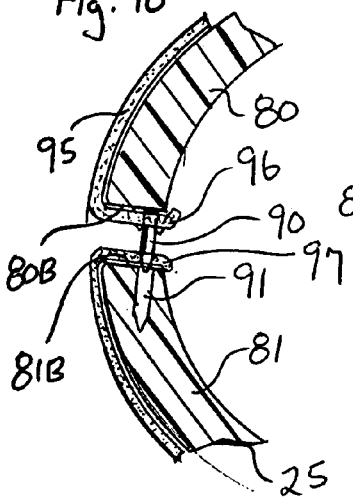
Fig. 12
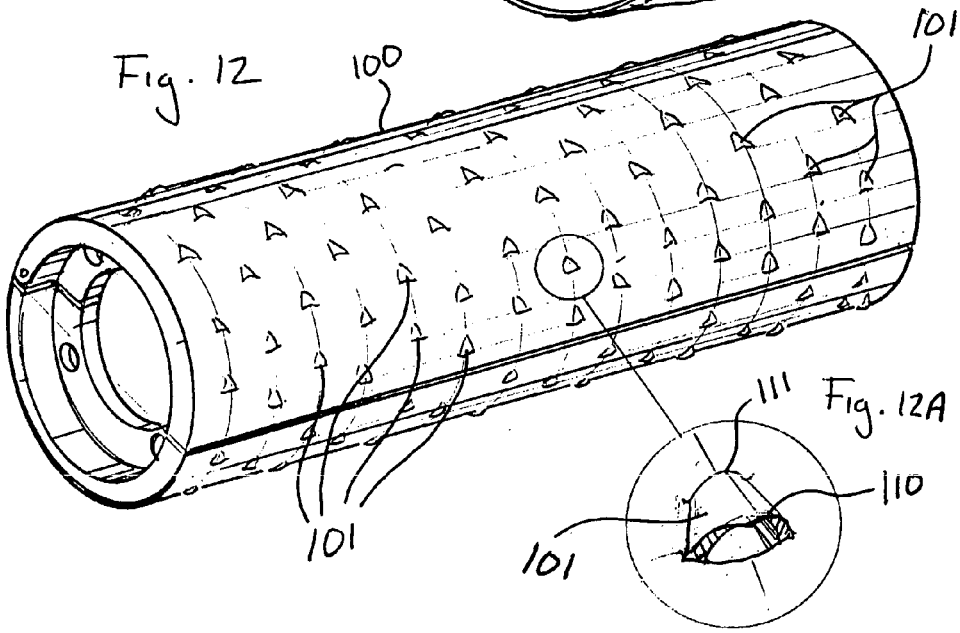
Fig. 12A

POWDER DRIVEN SURFACE FINISHING APPARATUS

FIELD OF THE INVENTION

The present invention relates to power tools and, more particularly, to power driven surface finishing devices.

BACKGROUND OF THE INVENTION

Numerous power-operated devices have been devised in which a motor rotates a rotatable member that is used to finish a surface when brought into contact therewith. Among the many surface-finishing devices presently available are those which are portable and light-weight and used to replace manual surface finishing of finished and unfinished surfaces, such as doors, jambs, floors, shutters, etc. Although adequate, known portable surface-finishing devices and sanders are difficult to construct, expensive, and cumbersome to use. Given these and other deficiencies in the art, the need for certain new and useful improvements is evident.

Thus, there is a need in the art for a simple portable surface finishing device that is inexpensive, simple to construct, balanced for easy and safe use, and reliable. Another object of the present invention is to provide a portable surface finishing device that is durable and lightweight, and that incorporates a surface finishing drum having a unique construction for facilitating easy and efficient sandpaper installation thereto removal therefrom after use.

SUMMARY OF THE INVENTION

The above problems and others are at least partially solved and the above objects and others realized in a surface finishing device including an elongate fixture having a handled extremity and an opposing working or business extremity. A surface finishing drum, bounding a chamber, is rotated to the working extremity. A drive assembly, operable with a switch conveniently located at the handled extremity of the elongate fixture, is disposed in the chamber and is operable for rotating the surface finishing drum. In a particular embodiment, the surface finishing drum defines an axis of rotation that is substantially perpendicular relative to the elongate fixture. In a preferred embodiment, the drive assembly consists of an electric motor and a drive shaft coupling the motor to an end of the surface finishing drum. A power cord is provided, which is coupled electrically the electric motor and is adapted to be received by an outlet of a dedicated power source, such as a wall outlet, for providing the electric motor with electrical power. In another embodiment, a battery power source is carried by the fixture and coupled electrically to the electric motor and provides the electric motor with electrical power. A shield, carried by the fixture, overlies the surface finishing drum and supports a vacuum hose coupling.

Another apparatus embodiment consists of a surface finishing device, which includes a surface finishing drum having opposing ends and a chamber therebetween, an elongate fixture having a handled proximal extremity and an opposing distal extremity, and a support element, which is carried by the distal extremity and extends through one of the ends of the surface finishing drum into the chamber. An electric motor, operable with a switch conveniently located at the handled extremity of the elongate fixture, is disposed in the chamber, is carried by the support element, and is operable for rotating the surface finishing drum. A drive shaft is also disposed in the chamber and couples the motor to the other of the ends of the surface finishing drum. In a particular embodiment, the surface finishing drum defines an axis of rotation that is substantially perpendicular relative to the elongate fixture. In one embodiment, a power cord is provided, which is coupled electrically the electric motor and is adapted to be received by an outlet of a dedicated power source, such as a wall outlet, for delivering electrical power to the electric motor. In another embodiment, a battery power source is carried by the fixture and coupled electrically to the electric motor for providing the electric motor with electrical power. A shield, carried by the fixture, overlies the surface finishing drum and supports a vacuum hose coupling.

Consistent with the foregoing summary of the invention and the ensuing specification, the invention also contemplates associated apparatus embodiments.

BRIEF DESCRIPTION OF THE DRAWINGS

Referring to the drawings:

FIG. 9 is a fragmented perspective view of the surface finishing drum of FIG. 6 shown as it would appear open with sandpaper wrapped thereabout;

FIG. 10 is a vertical sectional view illustrating confronting outer ends of the surface finishing drum of FIG. 6;

FIG. 12 is an alternate embodiment of a surface finishing drum; and

FIG. 12A is an enlarged perspective view of a cutting tooth of the surface finishing drum of FIG. 12.

DETAILED DESCRIPTION OF A PREFERRED EMBODIMENT

Figures 3, 4, 5:
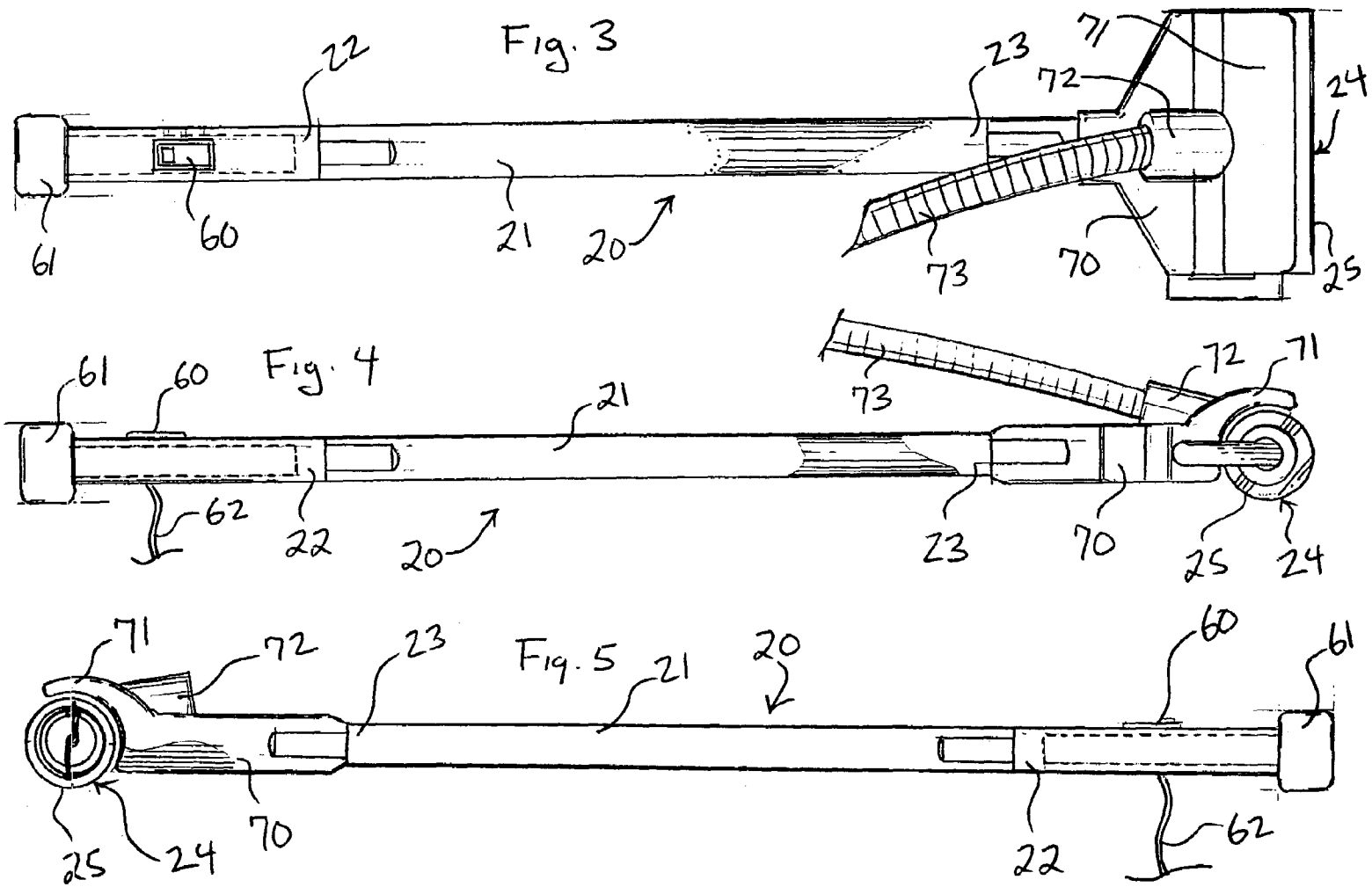
FIG. 3 is top plan view of the device of FIG. 1.
FIG. 4 is a right side elevational view of the device of FIG. 1.
FIG. 5 is a left side elevational view of the device of FIG. 1.

A surface finishing device 20 will now be described with reference to FIGS. 1–13. In the embodiment set forth in FIG. 1, device 20 consists of an elongate fixture 21 including a handled proximal extremity 22 and an opposing working or business distal extremity 23 having an attached surface finishing drum assembly 24. Surface finishing drum assembly 24 incorporates a surface finishing drum 25, which is rotated to distal extremity 23, and a drive assembly mounted therein, which is operable for rotating surface finishing drum 25 and will be discussed later in this specification. Surface finishing drum 25 defines an axis of rotation X that is substantially perpendicular relative to axis Y of fixture 21, in which axis Y is the longitudinal axis of fixture 21. Surface finishing drum 25 can be disposed in other orientations, if desired. For instance, surface finishing drum 25 can be disposed so as to make axes X and Y coaxial, substantially parallel to one another, angled relative to one another, etc. Fixture 21 is fashioned of plastic, aluminum, carbon fiber, or other rigid material or combination of materials. FIG. 3 is top plan view of device 20, FIG. 4 is a right side elevational view of device 20, and FIG. 5 is a left side elevational view of device 20. Device 20 is portable and light-weight, and is easily taken up by hand as in FIG. 1 for use in surface-finishing operations.

Figure 6:
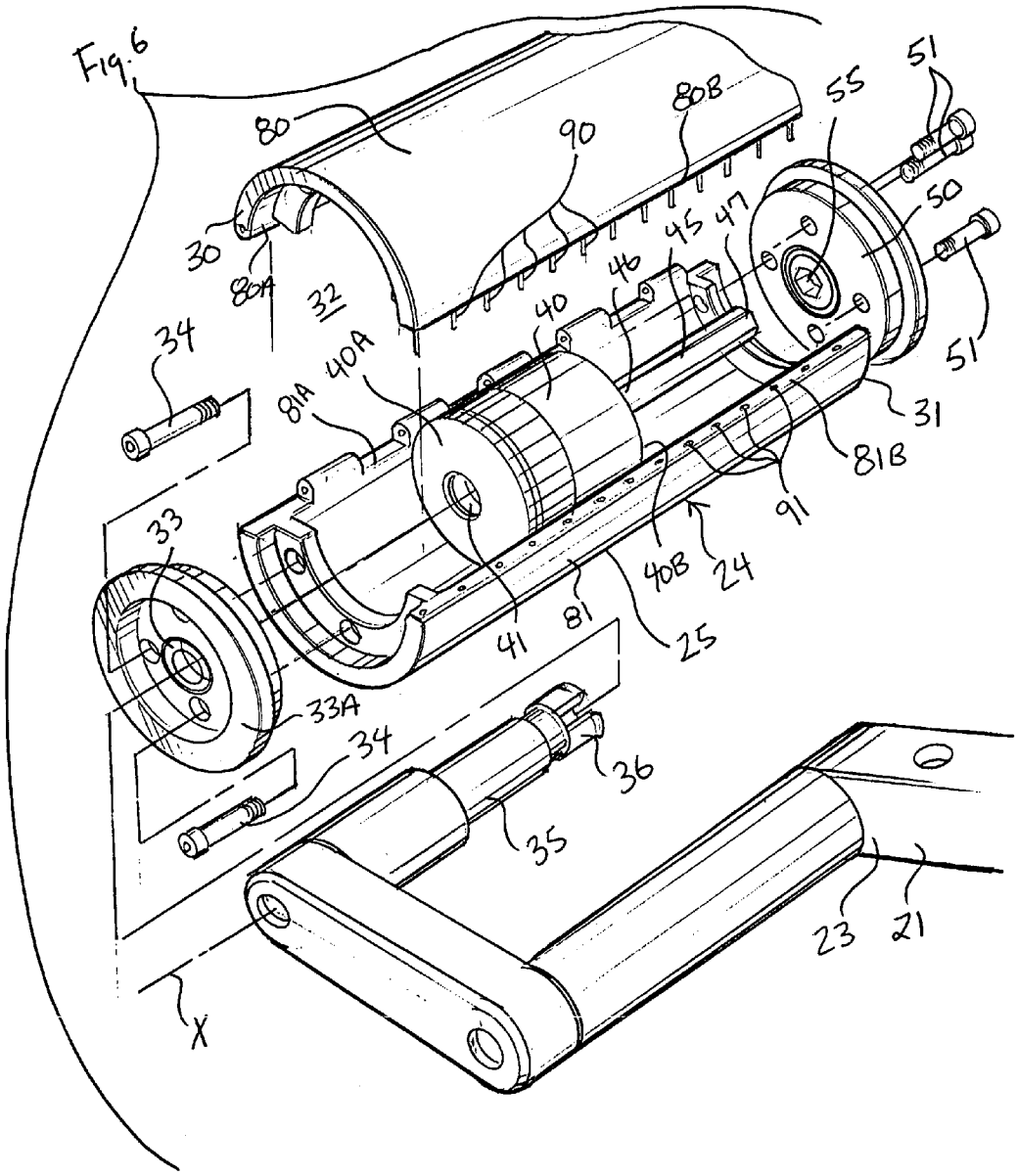
FIG. 6 is an exploded perspective view of the surface finishing drum assembly of FIG. 1 including a clamshell surface finishing drum and an interiorly mounted drive assembly.
Figure 7:
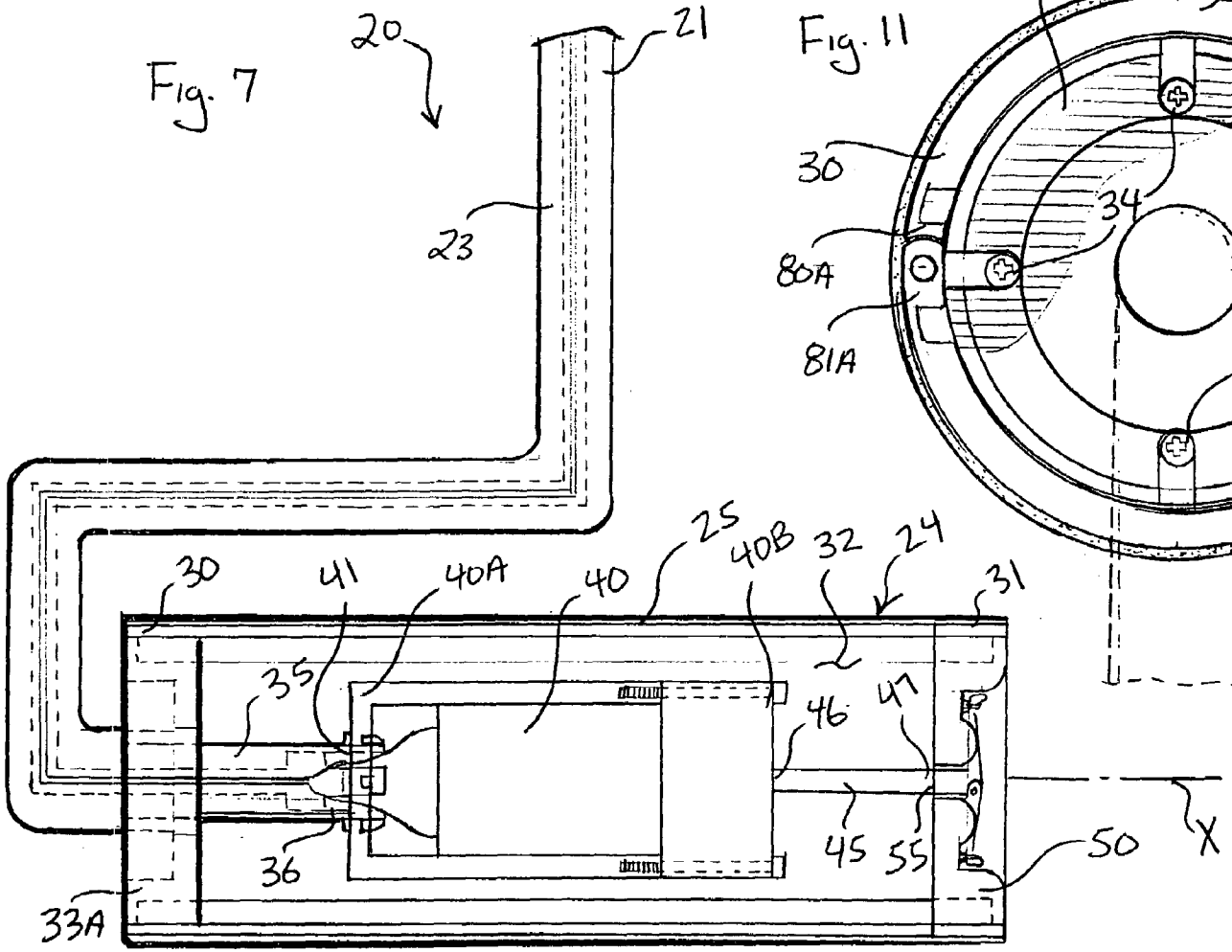
FIG. 7 is a vertical sectional view of the surface finishing drum assembly of FIG. 1 illustrating the drive assembly disposed within the surface finishing drum, both of FIG. 7.

FIG. 7 is a vertical sectional view of surface finishing drum assembly 24 and FIG. 6 depicts distal extremity 23 of fixture 21 including an exploded perspective view of surface finishing drum assembly 24. Surface finishing drum 25 is a cylinder having opposing ends 30,31, and bounds a chamber 32 therebetween. End 30 is considered a proximal end of surface finishing drum 25 and end 31 is considered a distal end of surface finishing drum 25. Distal extremity 23 of fixture 21 leads to, and supports, an elongate support element 35, which extends through end 30 of surface finishing drum 25 and into chamber 32 and is centered along axis X of rotation of surface finishing drum 25. A bearing 33 is carried by a cap 33A, which is attached to end 30 of surface finishing drum 25 with screws 34. Bearing 33 is fixed to cap 33A centrally and encircles, and rotates relative to, support element 35. Bearing 33 is conventional in nature and permits surface finishing drum 25 to rotate thereabout support element 35 while securing end 30 of surface finishing drum 25 to support element 35. This rotated attachment of bearing 33 to support element 35 is a conventional journaled attachment. Any number of screws 34 can be used to secure cap 33A, which is considered part of bearing 33, to end 30 of surface finishing drum 25. Screws 34 represent a preferred means of securing cap 33A to end 30 of surface finishing drum 25, because they can be easily removed for detaching surface finishing drum 25 from cap 33A, and thus from bearing 33. Those of ordinary skill will appreciate that other ways of detachably securing cap 33A to end 30 of surface finishing drum 25 can be used. When surface finishing drum 25 is attached to cap 33A, cap 33A and bearing 33 can each be considered part of surface finishing drum 25. Furthermore, cap 33A and end 30 of surface finishing drum 25 can be fashioned with engagement and detachably engagable complemental engagement elements for facilitating their mutual detachable engagement without the need for separate fasteners, such a complementing threaded engagement elements, complementing snap engagement elements, complementing keyed engagement elements, etc. Although surface finishing drum 25 is fixed to cap 33A which is fixed to bearing 33 in which bearing 33 rotates about support element 35, bearing 33 can be rigidly attached to support element 35 and adapted and arranged so as to permit cap 33A to rotate therebout. Alternatively, a journaled/bearing attachment can be made between end 30 of surface finishing drum 25 and cap 33A, if desired, so as to permit end 30 of surface finishing drum 25 to rotate about or otherwise relative to cap 33A, in which case cap 33A would be fixed to support element 35. It is to be understood that any suitable way of rotatably attaching surface finishing drum 25 can be used without departing from the invention.

Support element 35 terminates with a free end 36 in chamber 32, which is secured to a motor 40 having opposing ends 40A,40B. In the immediate embodiment, free end 36 is a keyed male engagement feature/element which projects into and is secured by a complementing keyed female engagement feature/element 41 formed into end 40A of motor 40, and this can be reversed. Any suitable key configuration can be used with free end 36 and feature 41. Those having regard for the art will readily appreciate that other ways of securing motor 40 to free end 36 of support element 35 can be used without departing from the invention and that other engagement and complemental engagement elements can be used such as mutual threaded engagement elements, mutual snap engagement elements, etc.

A drive shaft 45 couples motor 40 to surface finishing drum 25. Drive shaft 45 has an inner end 46 that is attached to motor 40, and is driven to rotate by motor 40 and thus functions to transmit rotational mechanical power from motor 40 to surface finishing drum 25. Drive shaft 45 projects away from end 40B of motor 40 and terminates with an opposing outer end 47, which is secured to a cap 50 attached to end 31 of surface finishing drum 25. Cap 50 is attached to end 31 of surface finishing drum 25 with screws 51. Any number of screws 51 can be used to secure cap 50 to end 31 of surface finishing drum 25. Screws 51 represent a preferred means of securing cap 50 to end 31 of surface finishing drum 25, because they can be easily removed for detaching surface finishing drum 25 from cap 50. Those of ordinary skill will appreciate that other ways of detachably securing cap 31 to end 31 of surface finishing drum 25 can be used. When cap 50 is attached to surface finishing drum 25, cap 50 can be considered part of surface finishing drum 25. Furthermore, cap 50 and end 31 of surface finishing drum 25 can be fashioned with engagement and detachably engagable complemental engagement elements for facilitating their mutual detachable engagement without the need for separate fasteners, such a complementing threaded engagement elements, complementing snap engagement elements, complementing keyed engagement elements, etc.

The combination of motor 40 and drive shaft 45 constitutes the drive assembly of the invention, functions to impart rotation to surface finishing drum 25, and is disposed entirely in chamber 32 of surface finishing drum 25. As can be seen in FIG. 7, a suitable spacing exists between motor 40 and the interior surface of surface finishing drum 25, which prevents motor 40 from interfering with the rotation of surface finishing drum 25.

Motor 40 is a conventional electric motor that incorporates a planetary gear assembly to which inner end 46 of drive shaft 45 is attached. Motor 40 drives drive shaft 45 for rotation and is generally representative of any of a wide variety of electric motors operable from transmitting rotational mechanical movement to a drive shaft. Accordingly, set forth for purposes of orientation and reference in connection with the ensuing detailed description of the preferred embodiment of the instant invention, the foregoing brief description of motor 40 is intended to be generally representative of electric motor operable for transmitting rotational mechanical power to a corresponding drive shaft. Details not specifically illustrated and described will be readily understood and appreciated by those skilled in the art. Other motor forms capable of rotating drive shaft 45 can be used, if desired, such as a pneumatic motor, a hydraulic motor, etc.

In the immediate embodiment, and with reference to FIG. 6, outer end 47 is a keyed male engagement feature/element which projects into and is secured by a complementing keyed female engagement feature/element 55 formed into the inner face of cap 50, and this can be reversed. In the preferred embodiment disclosed, end 47 and feature 55 have mating hexagonal shapes. Any suitable key configuration can be used with outer end 47 of drive shaft 45 and feature 55. Those having regard for the art will appreciate that other ways of securing outer end 47 of drive shaft 45 to cap 50 can be used without departing from the invention and that other engagement and complemental engagement elements can be used such as mutual threaded engagement elements, mutual snap engagement elements, etc.

Figures 1, 2:
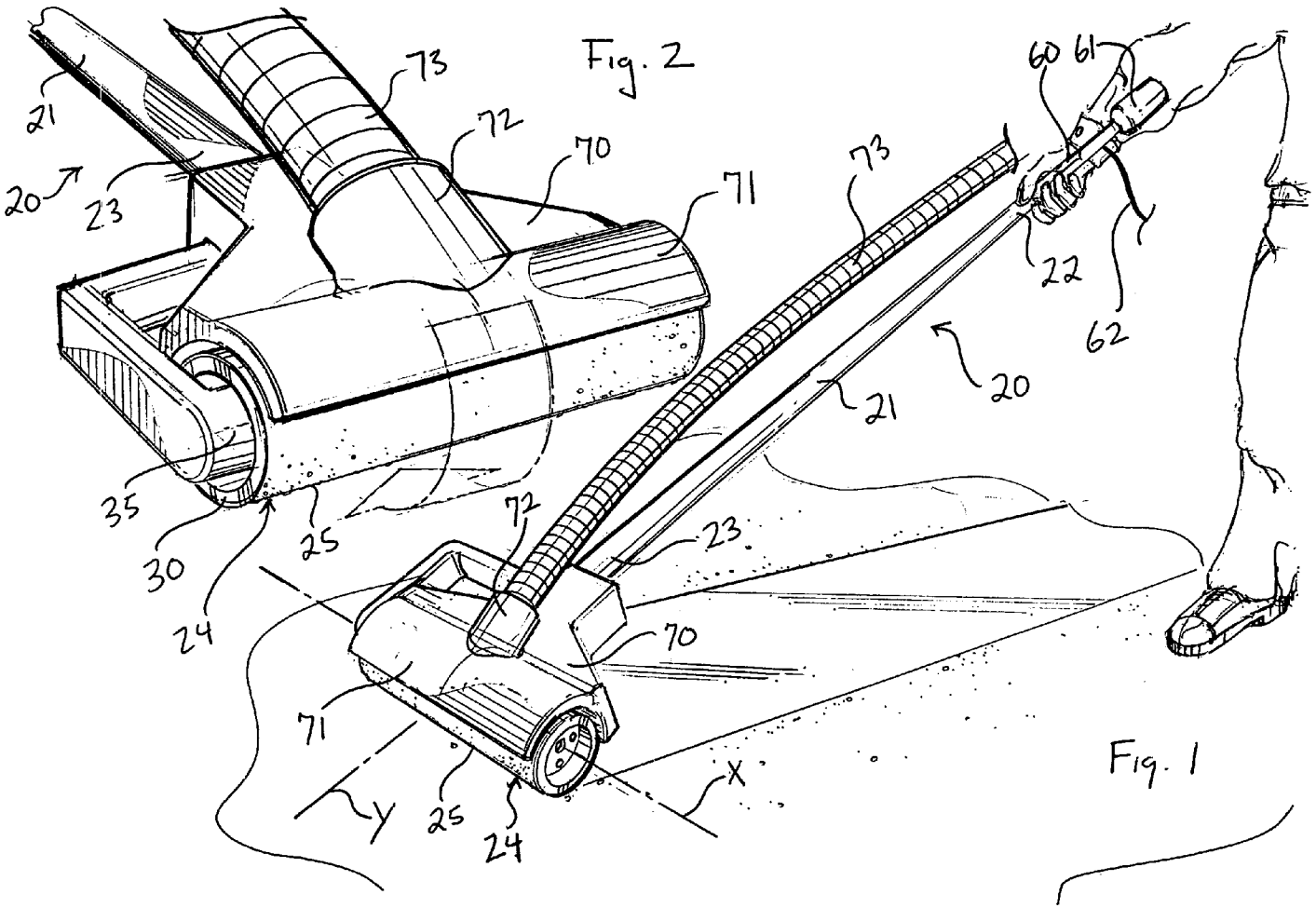
FIG. 1 is a perspective view of a powered surface-finishing device shown as it would appear in use finishing a surface, the device including an elongate fixture having a handled extremity and an opposing working extremity including an attached surface finishing drum assembly, in accordance with the principle of the invention.
FIG. 2 is an enlarged perspective view of the working extremity of the device of FIG. 1.

Turning back to FIG. 1, motor 40 (not shown in FIG. 1) is operable, e.g., turned ON and OFF, with a switch 60 conveniently located at handled extremity 22 of fixture 21. Switch 60 is coupled in electrical communication with motor 40 and with a power source using conventional wiring carried within fixture 21. Switch 60 is a conventional toggle switch, which is movable between ON and OFF positions for activating and deactivating motor 40. When switch 60 is open or otherwise disposed in its OFF position, a circuit between switch 60 and motor 40 is open and motor 40 is deactivated. When switch 60 is closed or otherwise disposed in its ON position, the circuit between switch 60 and motor 40 is closed permitting electrical power to flow to motor 40 from a power source activating motor 40 causing surface finishing drum 25 to rotate. Motor 40 is configured to rotate surface finishing drum 25 in a counterclockwise direction or a counter-clockwise direction. Preferably, device 20 is fashioned with an onboard power source, namely, a battery power source 61. Battery power source 61 is preferably a rechargeable lithium-cadmium battery, which is disposed at handled distal extremity 22 and attached to fixture 21 in a conventional manner, such as much like the way lithium-cadmium batteries attach to video cameras. Other ways of incorporating a lithium-cadmium battery to fixture 21 can be used, and other battery types can be used for battery power source 61. Although only one battery is shown, more can be employed if desired. As shown in FIGS. 1, 4, and 5, device 20 is also fashioned with a power cord 65, which is coupled electrically to electric motor 40 (not shown in FIGS. 1, 4, and 5) and is adapted to be received by an outlet of a dedicated power source, such as a wall outlet, for providing electric motor 40 with electrical power. Power cord 65 can be used for conducting electrical power from a remote power source in lieu of battery power source 61, if desired. Preferably, the circuitry of device 20 is also adapted and arranged to conduct electrical power from power cord 62 when in use to battery power source 60 for recharging it or otherwise keeping it charged for later use.

Device 20 can be easily taken up by hand, as in FIG. 1, and wielded so as to direct surface finishing drum 25 against a surface that requires finishing. By turning switch 600N, the drive assembly of device 20 drives surface finishing drum 25 rotating it. Surface finishing drum 25 is provided with an abrasive exterior surface for facilitating surface finishing in response to its rotation and application against a surface to be finished. The surface characteristic of the exterior surface of surface finishing drum 25 can be of any desired character for imparting a desired finishing effect, such as surface material removal, surface stripping, abrading, polishing, smoothing, cleaning, buffing, etc.

As seen in FIGS. 1 and 2, distal extremity 23 is fashioned with an attached housing assembly 70 that incorporates a shield 71, which overlies surface finishing drum 25 and serves to protect a user from flying debris removed by device 20 during use. Shield 71 carries or is otherwise formed with a vacuum hose coupling 72 that leads to surface finishing drum 25, and which is operative for receiving and coupling a vacuum hose 73 for use with a vacuum source for vacuum-collecting debris at surface finishing drum 25 and conducting it away, such as outside or to a debris collection container.

The disposition of motor 40 and drive shaft 45 of device 20 inside surface finishing drum 25 is highly desirable as it represents an efficient mounting arrangement, keeps the drive assembly free of debris and dust, and functions to impart the weight thereof to surface finishing drum 25. The ballast provided to surface finishing drum 25 by motor 40 and drive shaft 45 functions to urge surface finishing drum 25 against a surface to be finished, which reduces the amount of force a user needs to apply to device 20 to impress surface finishing drum 25 against a surface to be finished.

Figure 8:
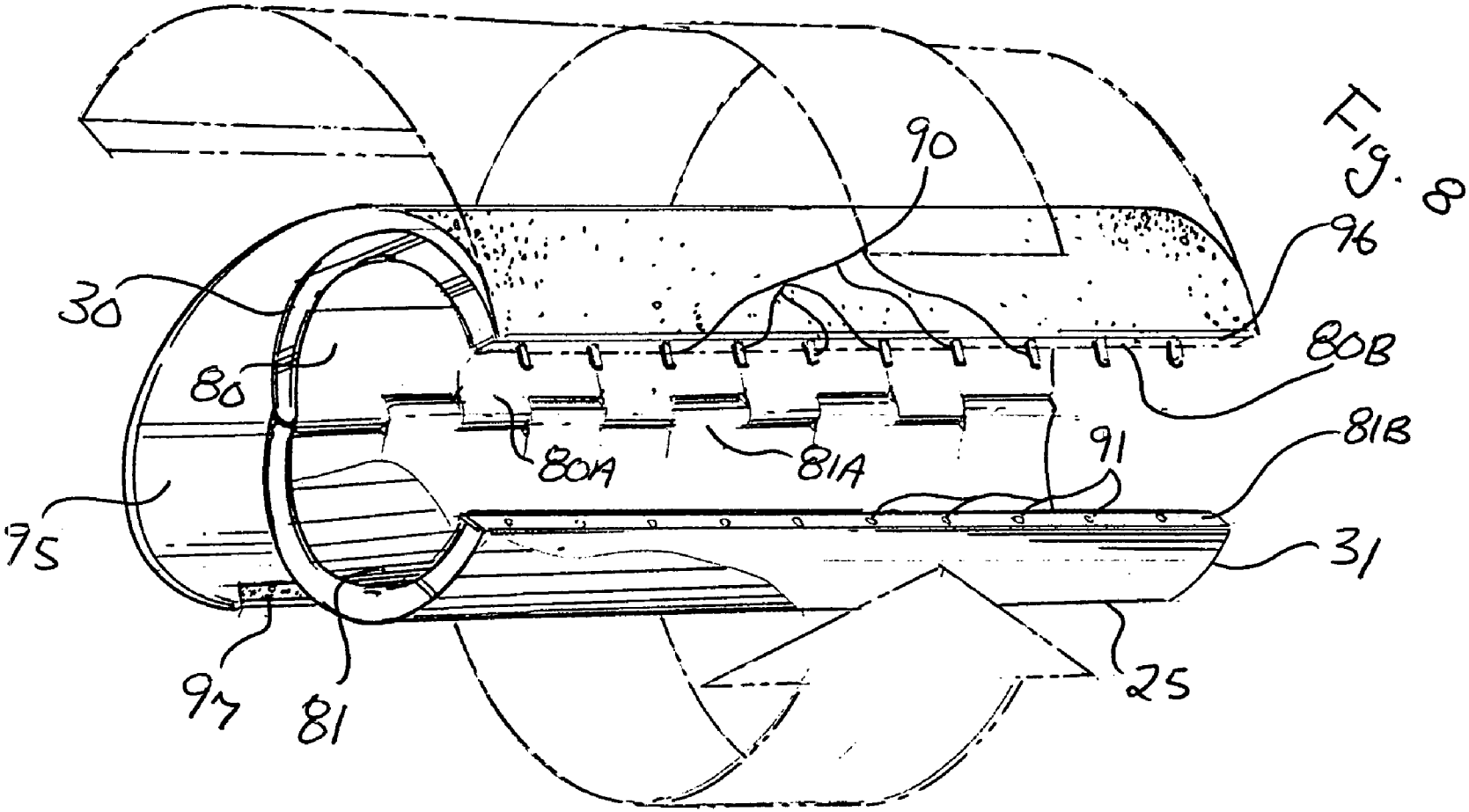
FIG. 8 is a perspective view of the surface finishing drum of FIG. 6 shown as it would appear open.

Referring to FIG. 8, surface finishing drum 25 is a clamshell body, which consists of a pair of elongate, coextensive, hinged jaws 80,81, which are movable between an open position (FIGS. 8 and 9) and a closed position (FIG. 11) forming the cylindrical shape of surface finishing drum 25. Jaws 80,81 have inner ends 80A,81A, respectively, which are hingedly coupled by way of a conventional hinged arrangement, and opposing and confronting outer ends 80B, 81, respectively. Outer end 80A carries teeth 90 disposed at spaced intervals along substantially the entire length thereof, and outer end 80B carries corresponding recesses 91 disposed at spaced intervals along substantially the entire length thereof, which receive therein teeth 90 when jaws 80,81 are closed, e.g., when ends 80B,81B are brought together.

Figure 11:
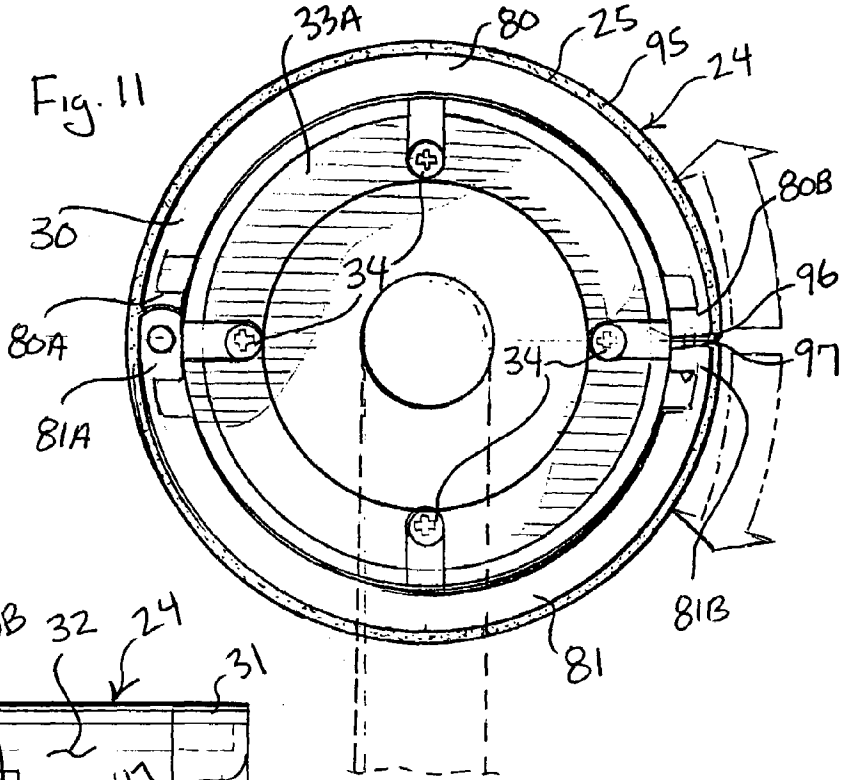
FIG. 11 is an end elevational view of the surface finishing drum of FIG. 6 shown as it would appear closed securing sand paper wrapped thereabout.

The abrasive surface carried by surface finishing drum 25 in the immediate embodiment is provided by a piece of externally-attached abrasive sandpaper 95, which, as shown seen in FIG. 9, is wrapped externally about jaws 80,81 and marginal edges 96,97 thereof wrapped over outer ends 80B,81B, respectively, in which teeth 90 are pierced through marginal extremity 96. Sandpaper 85 is secured in place to surface finishing drum 25 by closing jaws 80,81, in which teeth 90 pierce through marginal edge 97 of sandpaper 95 (FIG. 10) securing marginal edges 96,97 between outer ends 80B,81B of jaws 80,81 (FIG. 11). Sandpaper 95 is removed by reversing the foregoing operation, and can be replaced with new sandpaper in the manner herein described. The mating of teeth 90 with recesses 91 also functions to align jaws 80,81 together when they are closed. It is to be understood that the positioning of teeth 90 and recesses 91 can be reversed, that any number of corresponding pairs of teeth 90 and recesses 91 can be used, and that they can be mixed and matched as desired.

It is to be understood that after sandpaper 95 is installed and surface finishing drum 25 is closed it can be installed with device 20 by inserting motor 40 and shaft 45 into chamber 32 through end 30 of surface finishing drum 25 and then attaching end 30 of surface finishing drum 25 to bearing 33 and cap 50 to end 31 of surface finishing drum so as to engage outer end 47 of drive shaft 45 to cap 50 as previously discussed. Alternatively, surface finishing drum can be closed around motor 40 and drive shaft 45 if desired, and then end 30 secured to bearing 33 and end 31 secured to cap 50 so as to engage outer end 47 of drive shaft 45 to cap 50 as previously discussed.

The clamshell design of surface finishing drum 25 is advantageous because it allows easy access to motor 40 for maintenance and repair. The attachment of sandpaper 95 as described herein is just one way of furnishing surface finishing drum 25 with an external abrasive surface. In this regard, it is to be understood that an abrasive surface can be applied exteriorly to surface finishing drum 25 in other ways, such as adhesively, by way of spraying abrasive material directly onto the exterior surface of surface finishing drum 25, by actually forming the exterior surface of surface finishing drum 25 with an abrasive character, such as with an abrasive landscape, teeth, etc. As matter of example, FIG. 12 illustrates an alternate embodiment of a surface finishing drum, which is designated at 100. Surface finishing drum 100 is substantially identical to surface finishing drum 25, and it is to be understood that the foregoing discussion of surface finishing drum 25 applies to surface finishing drum 100. Unlike surface finishing drum 25, however, the exterior surface of surface finishing drum 100 is formed with surface cutting teeth 101. FIG. 12A is an enlarged perspective view of one of teeth 101 of surface finishing drum 100. Tooth 101 includes a leading cutting edge 110 and an opposing trailing end 111. Tooth 101 is hollow, which permits material removed by leading cutting edge 110 to pass therethrough tooth 101 from leading cutting edge 110 to trailing end 111 and fall away therefrom and away from surface finishing drum 100, eliminating clogging and removed material from collecting on surface finishing drum 100, which could otherwise diminish its effectiveness in removing material. In use, surface finishing drum 100 is driven to rotate so as to make teeth 101 lead with their leading cutting edges.

Consistent with this disclosure, it is to be understood that the exterior surface of a surface finishing drum for use with a surface finishing device constructed and arranged in accordance with the principle of the invention can embody any desired characteristic for imparting a desired finishing effect, such as such as surface material removal, surface stripping, abrading, polishing, smoothing, cleaning, buffing, etc. Accordingly, the application of an exterior surface characteristic as discussed with drums 25,100 also applies to other forms of exterior surface characteristics.

The present invention is described above with reference to a preferred embodiment. However, those skilled in the art will recognize that changes and modifications may be made in the described embodiment without departing from the nature and scope of the present invention. For instance, fixture 21 can be made of various lengths depending on particular needs, and fixture 21 can also be fashioned with an extender, such as a telescoping assembly, for facilitating length adjustment of device 20. A separate extender element can also be provided and attached to fixture 21 so as to increase the overall length of device 20, if desired. Device 20 can also be furnished with dust collection and filtration attachments. Further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A surface finishing device comprising:

a surface finishing drum having opposing first and second ends and a chamber therebetween;

the second end of the surface finishing drum formed with one of a key and a keyhole;

an elongate fixture having a handled proximal extremity and an opposing distal extremity;

a support element, carried by the distal extremity, which extends through the first end of the surface finishing drum into the chamber;

the first end of the surface finishing drum rotatably mounted to the support element extending therethrough;

an electric motor, disposed in the chamber, carried by the support element;

a drive shaft, disposed in the chamber, having an inner end coupled to the motor and an opposing outer end;

the outer end of the drive shaft formed with the other one of the key and the keyhole; and the key projecting into and secured by the keyhole coupling the outer end of the drive shaft to the second end of the surface finishing drum.

2. The surface finishing device of claim 1, wherein the surface finishing drum defines an axis of rotation that is substantially perpendicular relative to the elongate fixture.

3. The surface finishing device of claim 1, further comprising a power cord coupled electrically to the electric motor.

4. The surface finishing device of claim 1, further comprising a battery power source, carried by the fixture, coupled electrically to the electric motor.

5. The surface finishing device of claim 1, further comprising a shield, carried by the fixture, overlying the surface finishing drum.

6. The surface finishing device of claim 5, wherein the shield supports a vacuum hose coupling.

7. A surface finishing device comprising:

a surface finishing drum having opposing first and second ends and a chamber therebetween;

the second end of the surface finishing drum formed with one of a key and a keyhole;

an elongate fixture having a handled proximal extremity and an opposing distal extremity;

a support element, carried by the distal extremity, which extends through the first end of the surface finishing drum into the chamber;

the first end of the surface finishing drum rotatably mounted to the support element extending therethrough;

an electric motor, disposed in the chamber, carried by the support element;

a drive shaft, disposed in the chamber, having an inner end coupled to the motor and an opposing outer end;

the outer end of the drive shaft formed with the other one of the key and the keyhole;

the key projecting into and secured by the keyhole coupling the outer end of the drive shaft to the second end of the surface finishing drum;

a shield, carried by the fixture, overlying the surface finishing drum; and a vacuum hose coupling supported by the shield.

8. The surface finishing device of claim 7, wherein the surface finishing drum defines an axis of rotation that is substantially perpendicular relative to the elongate fixture.

9. The surface finishing device of claim 7, further comprising a power cord coupled electrically to the electric motor.

10. The surface finishing device of claim 7, further comprising a battery power source, carried by the fixture, coupled electrically to the electric motor.

* * * * *